US008157369B2

(12) United States Patent
Hoover et al.

(10) Patent No.: US 8,157,369 B2
(45) Date of Patent: Apr. 17, 2012

(54) MEDIA HOLD-DOWN SYSTEM HAVING CROSS PROCESS CHAMBERING

(75) Inventors: Linn C. Hoover, Webster, NY (US); Barry Paul Mandel, Fairport, NY (US); Ruddy Castillo, Briarwood, NY (US); Matthew Dondiego, West Milford, NJ (US); Joannes N. M. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 183 days.

(21) Appl. No.: 12/787,984

(22) Filed: May 26, 2010

(65) Prior Publication Data

US 2011/0292145 A1 Dec. 1, 2011

(51) Int. Cl.

| | |
|---|---|
| ***B41J 29/38*** | (2006.01) |
| ***B41J 2/01*** | (2006.01) |
| ***B41J 11/06*** | (2006.01) |
| ***B41J 13/00*** | (2006.01) |
| ***B65H 7/20*** | (2006.01) |
| ***B65H 7/06*** | (2006.01) |
| ***B65H 5/22*** | (2006.01) |

(52) U.S. Cl. ..... 347/104; 347/16

(58) Field of Classification Search ..... 347/16, 347/102

See application file for complete search history.

(56) References Cited

U.S. PATENT DOCUMENTS

| | | | | |
|---|---|---|---|---|
| 6,406,017 | B1 * | 6/2002 | Yaneda | 271/276 |
| 6,571,701 | B1 | 6/2003 | Pham-Van-Diep et al. | |
| 7,296,792 | B2 | 11/2007 | Kondratuk et al. | |
| 2006/0279752 | A1 * | 12/2006 | Hatasa et al. | 358/1.8 |
| 2010/0171804 | A1 * | 7/2010 | Takahashi et al. | 347/104 |

* cited by examiner

*Primary Examiner* — Julian Huffman

(74) *Attorney, Agent, or Firm* — Pepper Hamilton LLP

(57) ABSTRACT

A printable media hold-down system includes a print head array, a transport surface positioned adjacent to the print head array which transports a printable medium past the print head array in a location where the print head array may apply ink to the printable medium, and a vacuum system that creates vacuum pressure that holds the printable medium to the transport surface, the vacuum system having at least one adjustable baffle configured to move in a cross process direction and change a dimension of the vacuum system based on a dimension of the printable medium.

17 Claims, 7 Drawing Sheets

MEDIA HOLD-DOWN SYSTEM HAVING CROSS PROCESS CHAMBERING

CROSS-REFERENCE TO RELATED APPLICATION

This application is related to U.S. patent application Ser. No. 12/389,023, filed Feb. 19, 2009, the content of which is hereby incorporated by reference in its entirety.

BACKGROUND

The present disclosure relates to printable media transport and hold-down systems. More specifically, the present disclosure relates to movable guides used to overlap and hold down printable media such as paper, cardstock, or other substrates.

Direct-to-paper ink jet printing systems typically include a printable media hold-down system. As a printable medium passes on a transport surface under an ink jet print head, the hold-down system attempts to prevent contact between the printable medium and the print head. Contact between printable media and the print head may result in fibers from printable media becoming lodged in ink nozzles in the print head. Over time, a substantial number of fibers could become lodged in the nozzles causing the print head to clog. A clogged print head can damage printable media by printing incorrectly, wasting ink and causing significant downtime as the clogged head must be cleaned and/or replaced.

Some high speed printing systems, or systems for printing larger sizes of printable media, may require a large array of print heads. A clogged print head is especially troubling when using a print head array. Cleaning and/or replacing the print heads in a print head array can cause an even greater downtime depending on the size of the print head array.

Several hold-down systems are prevalent in modern direct-to-paper printing systems. One example is a vacuum/plenum system. In this system, a series of small holes are placed in the transport surface, and air is sucked through the holes, away from the print head (or print head array). As the printable medium passes under the print head (or print head array), a vacuum is created under the printable medium, thereby holding the printable medium against the transport surface.

Another exemplary hold-down system is an electrostatic tacking hold-down system. In this system, the transport surface is electrostatically charged, resulting in the printable medium tacking, or electrostatically sticking, to the transport surface as the printable medium moves under the print head (or print head array).

Both of these hold-down systems have inherent problems, however. Specifically, both of these approaches have limits to the amount of force that can be applied across printable media to protect printable media from coming into contact with the print head (or print head array). Both of these approaches are particularly susceptible to failure at the corners and edges of printable media. At the corners and edges, the downward force caused by the vacuum is less than at other portions of a printable medium due to air leakage around the edge of the printable medium, and the force exerted by an electrostatic system decreases if the sheet edge is not in intimate contact with the belt. Also, at the corners at edges, the bending moment imparted by the vacuum or the electrostatic tacking is lowest, which can result in the corners and edges bending away from the transport surface and contacting the print head (or print head array).

SUMMARY

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this document is to be construed as an admission that the embodiments described in this document are not entitled to antedate such disclosure by virtue of prior invention. As used in this document, the term "comprising" means "including, but not limited to."

In one general respect, the embodiments disclose a printable media hold-down system. The printable media hold-down system includes a print head array, a transport surface positioned adjacent to the print head array which transports a printable medium past the print head array in a location where the print head array may apply ink to the printable medium, and a vacuum system that creates vacuum pressure that holds the printable medium to the transport surface, the vacuum system having at least one adjustable baffle configured to move in a cross process direction and change a dimension of the vacuum system based on a dimension of the printable medium.

In another general respect, the embodiments disclose an alternative printable media hold-down system. The alternative printable media hold-down system includes a print head array, a transport surface positioned adjacent to the print head array which transports a printable medium past the print head array in a location where the print head array may apply ink to the printable medium, and a vacuum system that creates an area of vacuum pressure that holds the printable medium to the transport surface, wherein the vacuum pressure applied to an edge region of the printable medium parallel to a process direction of the printable medium is higher that the vacuum pressure applied to an interior region of the printable medium.

In another general respect, the embodiments disclose an additional alternative printable media hold-down system. The additional alternative printable media hold-down system includes a print head array, a transport surface positioned adjacent to the print head array which transports a printable medium past the print head array in a location where the print head array may apply ink to the printable medium, at least one sensor for detecting size and dimension information of the printable medium, and a vacuum system that creates vacuum pressure that holds the printable medium to the transport surface, the vacuum system having at least one adjustable baffle configured to change a dimension of the vacuum system based on a dimension of the printable medium.

DETAILED DESCRIPTION

For purposes of the discussion below, a "printable medium" refers to a physical sheet of paper, plastic and/or other suitable substrate for printing images thereon.

A "print head" refers to a device configured to disperse ink onto a printable medium.

A "print head array" refers to one or more print heads configured to disperse ink onto a printable medium.

A "transport surface" refers to a porous or non-porous surface on which a printable medium is transported past a print head or print head array.

A "vacuum chamber" refers to an enclosed space where a quantity of air may be removed to create a negative pressure in the enclose space.

Figure 1:
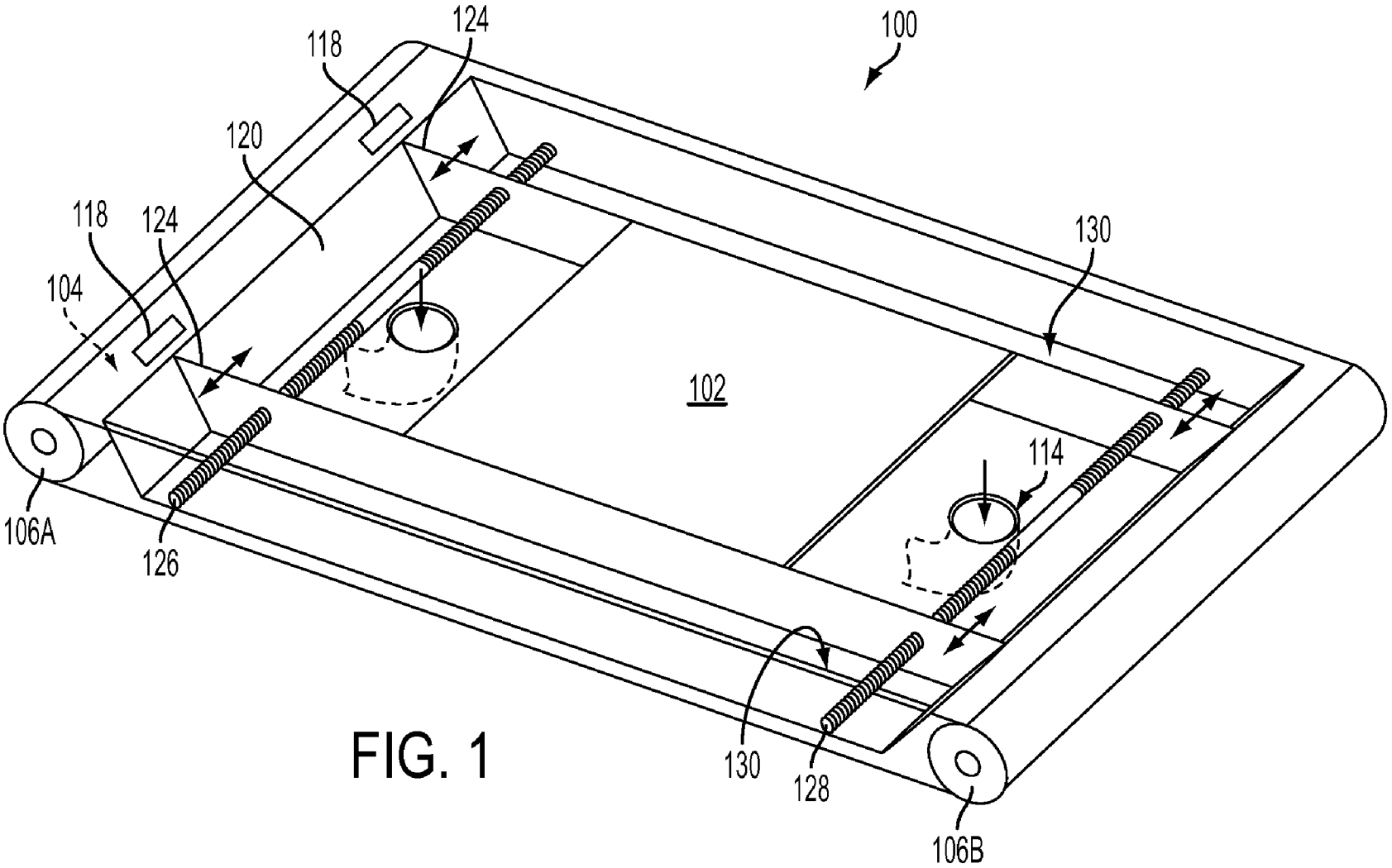
FIG. 1 illustrates an exemplary media transport system having an adjustable vacuum chamber according to an embodiment.

FIG. 1 illustrates an isometric view of a printable media hold-down system 100. A printable medium 102 may be placed on transport surface 104 for transporting under one or more print head arrays (not shown). Transport surface 104 is essentially a belt that loops around two rollers, roller 106A and roller 106B. The transport surface 104 may be stretched tightly over rollers 106A and 106B such that if either roller turns, the transport surface may move as well in a process direction, e.g., the direction that a piece of printable media moves through a printing system. The transport surface 104 may transport the printable medium 102 past one or more sensors 118. The one or more sensors 118 may be used to determine the size of the printable medium 102 as the printable medium moves in the process direction. For example, the sensors 118 may detect a presence of the printable medium 102 and pass the information to a processor. The processor may consider the time that the sensors 118 detected the printable medium 102 and the speed of the transport surface 104 to determine the length of the printable medium. Alternatively, the sensors 118 may be positioned to identify the edges of the printable medium 102 and thus determine width.

The transport surface 104 may include a vacuum/plenum system or an electrostatic system of holding the printable medium 102 down flat. In this example, a vacuum system 114 may include one or more adjustable baffles 124. The adjustable baffles 124 may be configured such that they move in a cross process direction, e.g., a direction perpendicular to the direction a piece of printable media moves through the printing system, thus changing the cross process dimension of a vacuum chamber 120. The adjustable baffles 124 may be positioned such that they define the vacuum chamber 120 as well as one or more areas 130 having no vacuum pressure created by the vacuum system 114.

The adjustable baffles 124 may be connected to various baffle drives 126 and 128. The baffle drives 126 and 128 may be a metal rod having threads on each end such that as the drives turn, the adjustable baffles 124 move in either an inboard or outboard direction. The threads may be oriented such that as the drives 126 and 128 turn, the adjustable baffles 124 move in opposite directions of each other. Conversely, the threads may be oriented such that the adjustable baffles 124 move in the same direction.

By moving the adjustable baffles 124, the printable media hold-down system 100 may change the size of the vacuum chamber 120, thus changing the surface area on transport surface 104 where vacuum pressure is present. This arrangement may reduce the requirements of vacuum system 114 by eliminating wasted vacuum suction on areas of the transport surface 104 not transporting the printable media 102.

Figure 2A:
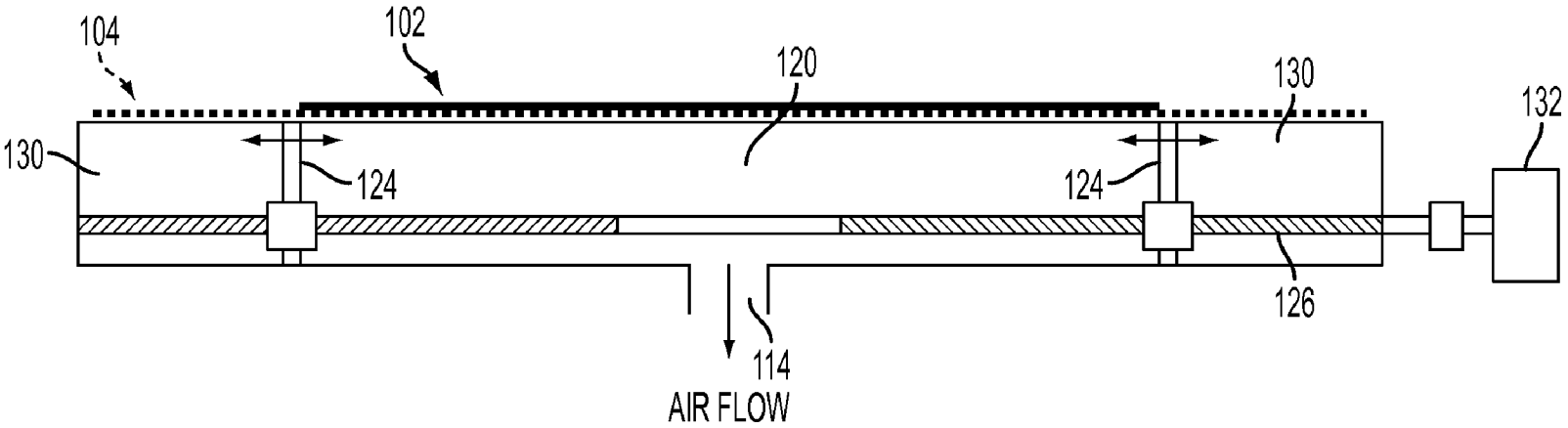
FIGS. 2A and 2B illustrate additional examples of an exemplary media transport system having an adjustable vacuum chamber according to an embodiment.
Figure 2B:
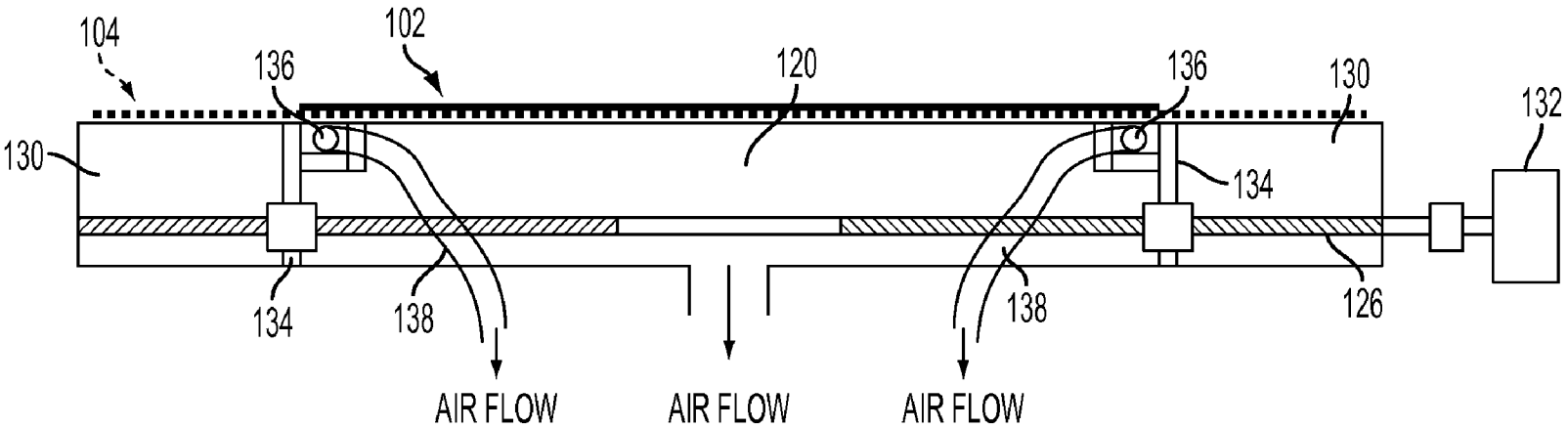

FIGS. 2A and 2B illustrate exemplary end views of various embodiments of the printable media hold-down system 100 as discussed above in FIG. 1. FIG. 2A illustrates printable medium 102 passing over vacuum chamber 120 via the transport surface 104. The vacuum pressure created by vacuum system 114 in vacuum chamber 120 may exert a vacuum on the printable medium 102, thereby resulting in the printable medium being flatly held against the transport surface 104.

As the printable medium approaches the vacuum chamber 120, the size of the printable medium may be determined via a set of one or more sensors (e.g., the sensors 118, not shown in FIG. 2A). Once the size is determined, the adjustable baffles 124 may be positioned such that the vacuum chamber 120 is sized appropriately for the printable medium. To change the size of the vacuum chamber 120, a motor 132 may turn the baffle drives (please note only baffle drive 126 is visible in FIG. 2A), thus moving the location of the adjustable baffles 124 and changing the size of the vacuum chamber 120. As mentioned above, the baffle drive 126 may have threads oriented such that the adjustable baffles 124 move in opposite directions as motor 132 turns the baffle drive.

Depending on the capabilities of the motor 132, a home sensor may be included such that the adjustable baffles 124 are returned to a standard position after a printable medium passes, or after a run of same sized printable media is completed. The motor 132 may be a stepper motor having a series of defined rotations wherein each rotation corresponds to a particular distance. For example, if the adjustable baffles 124 return to a home position such that the vacuum chamber 120 is at its largest size (i.e., the adjustable baffles are at the extreme outboard and inboard positions), and an approaching printable medium is measured to be 8 inches wide, the motor 132 may move the baffle drive 126 until the adjustable baffles are positioned such that the vacuum chamber is optimally sized for an 8 inch wide printable medium.

It should be noted that a stepper motor is include by way of example only. Additional motors such as electric servo motors, induction motors, or other similar devices may be incorporated.

FIG. 2B illustrates an additional exemplary printable media hold-down system. As before, printable medium 102 may pass over vacuum chamber 120 via the transport surface 104. The vacuum pressure created by the vacuum system 114 in the vacuum chamber 120 may exert a first vacuum on the printable medium 102, thereby resulting in the printable medium being flatly held against the transport surface 104. However, with this arrangement, there still may be air leakage around the edges of the printable medium 102, thus resulting in the edges curling away from the transport surface 104. In the system shown in FIG. 2B, alternative adjustable baffles 134 may be included. The alternative adjustable baffles 134 may include a small, high pressure vacuum chamber 136.

Each high pressure vacuum chamber 136 may include a vacuum duct 138 to create a high pressure vacuum in the chamber. As the alternative adjustable baffles 134 may move, thereby moving the high pressure vacuum chambers 136, the vacuum ducts 138 may be constructed from a lightweight flexible material such that the ducts do not impede the movement of the alternative adjustable baffles.

As discussed above, as the printable medium 102 approaches the vacuum chamber 120, the size of the printable medium may be determined via a set of sensors (e.g., the sensors 118, not shown in FIG. 2B). Once the size is determined, the alternative adjustable baffles 134 may be positioned such that the vacuum chamber 120 is sized appropriately for the printable medium. As a result of the alternative adjustable baffles 134 moving to size vacuum chamber 120 appropriately, high pressure vacuum chambers 136 may be positioned such that they are at or near the edge regions of the printable medium parallel to the process direction (e.g., 0-6 mm beyond the edge of the printable medium), thereby providing a higher vacuum pressure at the edge regions of the printable medium parallel to the process direction that in an interior region between the edge regions. An exemplary low vacuum pressure may be at or about 2-4 inches $H_20$ (approximately 0.072-0.144 pounds per square inch). Conversely, an exemplary high vacuum pressure may be at or about 5-10 inches $H_20$ (approximately 0.181-0.361 pounds per square inch).

Figure 3A:
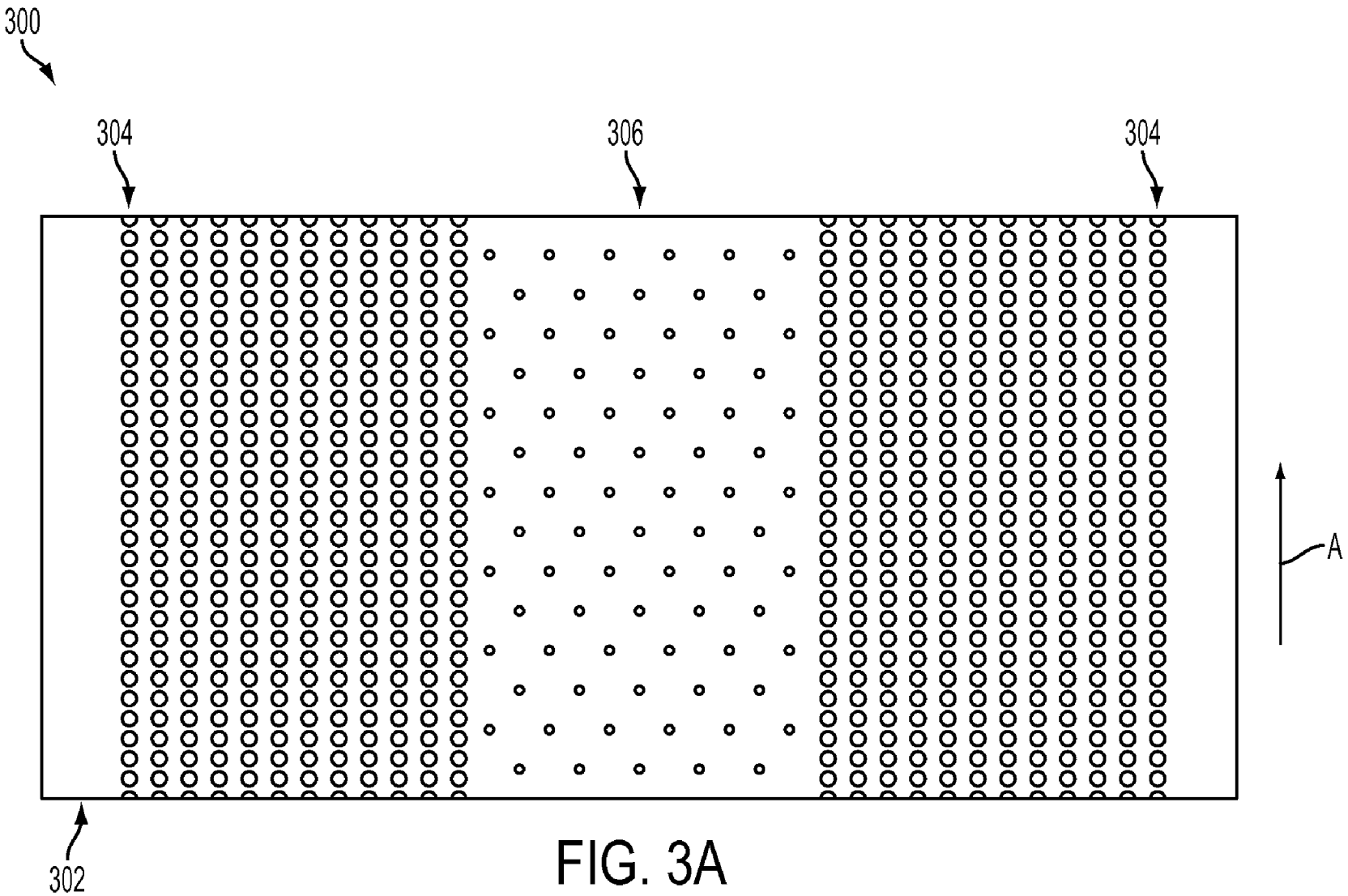
FIGS. 3A and 3B illustrate an exemplary printable media transport system having a transport surface with multiple hole sizes for creating varying vacuum pressures according to an embodiment.

FIGS. 3A-5 describe alternative embodiments for a printable media hold-down system where different vacuum pressures may be applied at the edges of a printable medium as compared to any vacuum pressures applied to the center of the printable medium. FIG. 3A illustrates an exemplary printable media hold-down system 300 having various sized and positioned holes in a transport surface 302. As the transport surface 302 moves in a process direction indicated by arrow A, two sets of larger holes 304 may be positioned such that the larger holes are positioned under the edge regions of the printable medium parallel to the process direction. A set of smaller holes 306 may be positioned between the sets of larger holes 304 to a smaller vacuum pressure on the interior or middle region of the printable medium. The vacuum pressure exerted on the printable medium may be directly related to the amount of air being removed around the printable medium, thus the larger holes 304 may provide a higher vacuum pressure than the smaller holes 306.

Figure 3B:
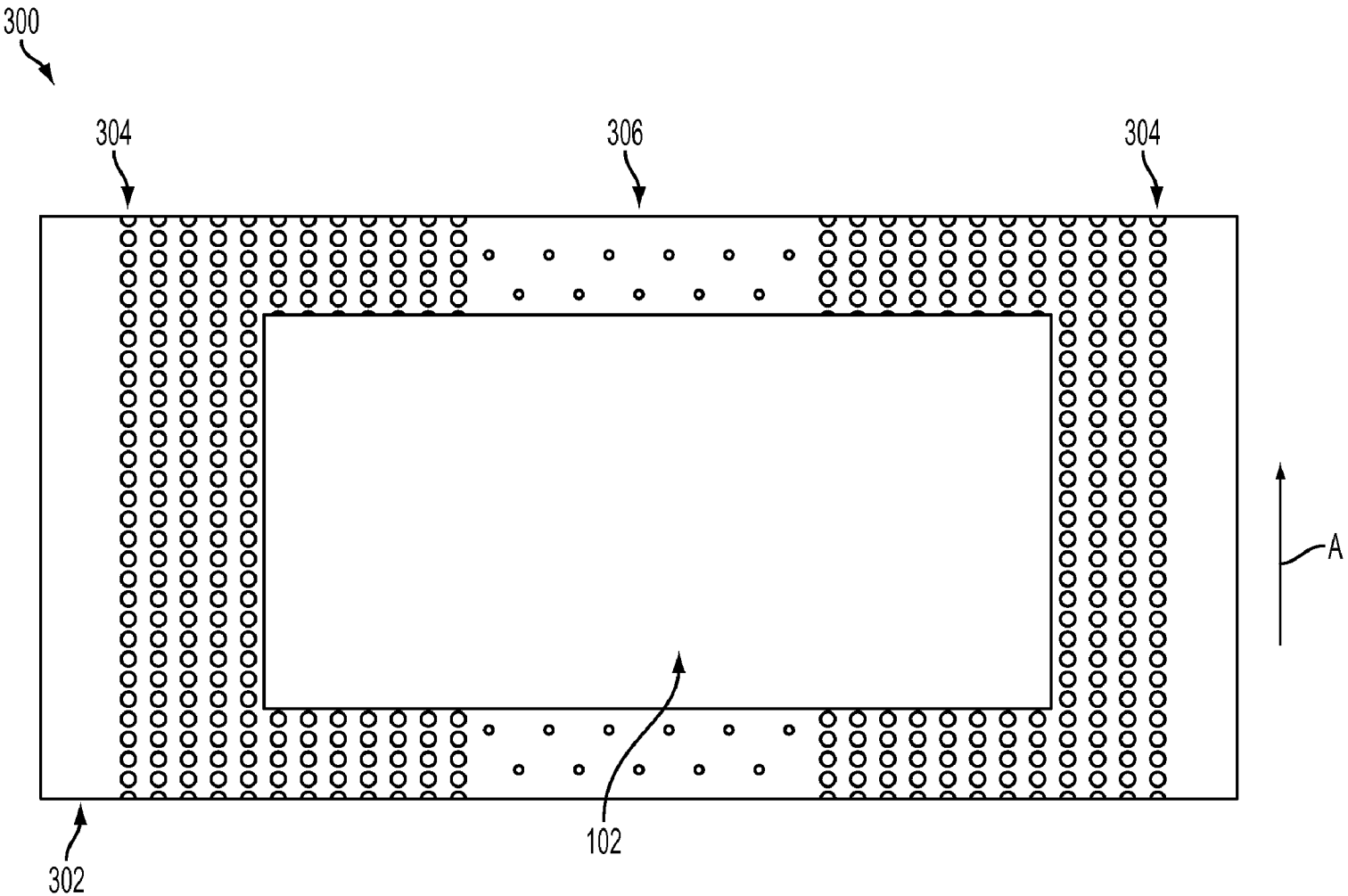

The larger holes 304 and the smaller holes 306 may be positioned such that the largest and smallest sizes of printable media that may be transported are accommodated. For example, if a printing device is configured to handle printable media ranging from 8 inches to 16 inches, the larger holes may be positioned such that the edges parallel to the process direction of all sizes of printable media between 8 inches and 16 inches are positioned in the larger holes 304. FIG. 3B illustrates the printable media hold-down system 300 as a printable medium 102 is transported by the transport surface 302 in a process direction shown by arrow A. As shown, the edge regions of printable medium 102 parallel to the process direction may be positioned on the transport surface 302 above the larger holes 304 such that the additional vacuum pressure created by the larger holes is applied to the edge regions of the printable medium. The interior region of the printable medium 102, which is less likely to pull away from the transport belt 302, may be positioned over the small holes 306.

It should be noted the sizes and patterns of the holes in transport surface 302 as shown in FIGS. 3A and 3B are shown by way of example only. The holes may be staggered in any particular pattern, or arranged in various other patterns. Additionally, depending on the type of printable media to be printed, the diameters of the holes may vary accordingly.

Figure 4A:
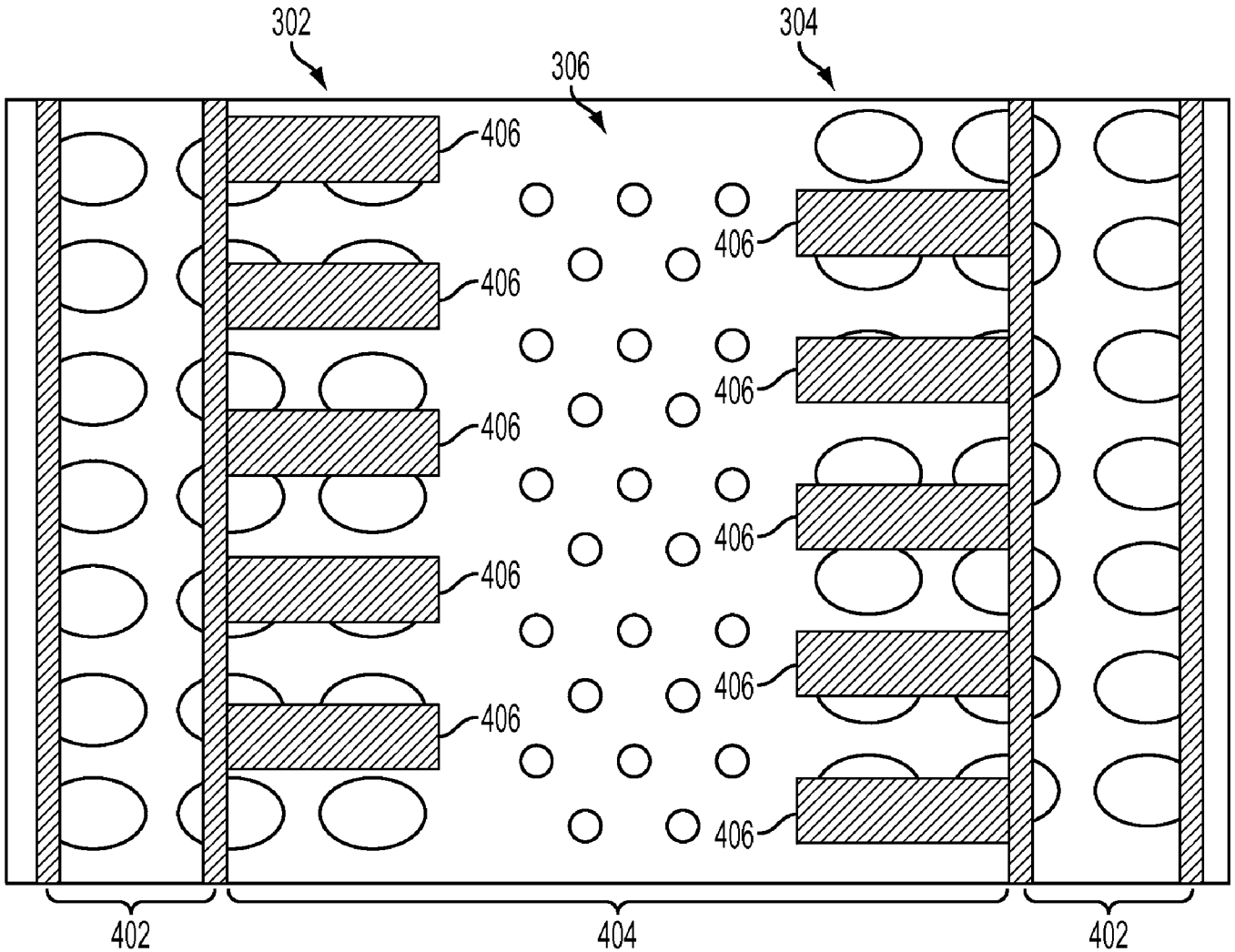
FIGS. 4A and 4B illustrate an exemplary printable media transport system having a set of tabs for altering the vacuum pressure exerted on a printable medium on a transport surface according to an embodiment.
Figure 4B:
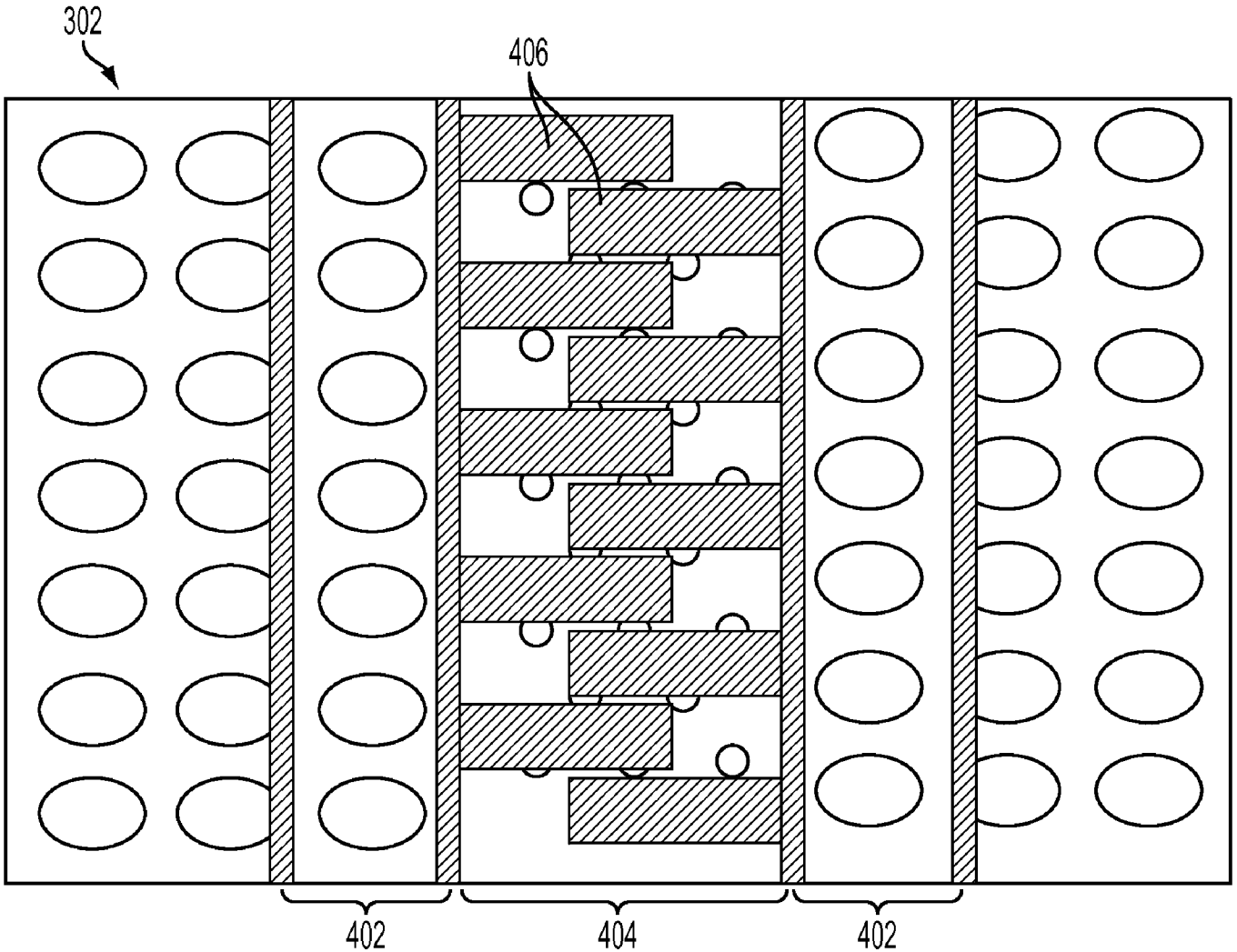

FIGS. 4A and 4B illustrate an exemplary combination of a similar hold-down system as discussed above in reference to FIG. 2B and the transport surface 302 of FIG. 3. A similar adjustable baffle such as alternative adjustable baffle 134 creates an area of high vacuum pressure 402 adjacent to a portion of the larger holes 304 of transport surface 302. Depending on the position of the adjustable baffles, an area of low vacuum pressure 404 may be created adjacent to a portion of the larger holes 304 and the smaller holes 306 of the transport surface 302. As a low vacuum pressure area may be used between the adjustable baffles, and to lower any requirements of a vacuum system creating the area of low vacuum pressure 404, a series of tabs 406 may be attached to the adjustable baffles such that a portion of the holes 304 and 306 in the transport surface 302 are blocked. The tabs 406 may be positioned on the adjustable baffles such that the air flow in the area of high vacuum pressure 402 remains unaffected.

The tabs 406 may be removably or permanently attached to the adjustable baffles such that the tabs move in concert with any movement of the adjustable baffles. Thus, as the adjustable baffles move to accommodate various sizes of printable media, the tabs 406 move as well. FIG. 4B shows an exemplary version of the adjustable baffles moving closer together to accommodate a narrower printable medium. As shown in FIG. 4B, the tabs 406 may be arranged in an interlocking pattern such that the adjustable baffles may move closer to one another, thereby reducing the area of low vacuum pressure 404.

The arrangement of the tabs 406 as shown in FIGS. 4A and 4B is shown by way of example only. Alternative arrangements may be utilized depending on the application of the printable media hold-down system. Additionally, the length of the tabs 406 may vary dependent upon the application. For example, the length of the tabs may be based upon a minimum size of printable media being used such that the printable media hold-down system is fully capable of handling all sizes of media to be printed.

Figure 5:
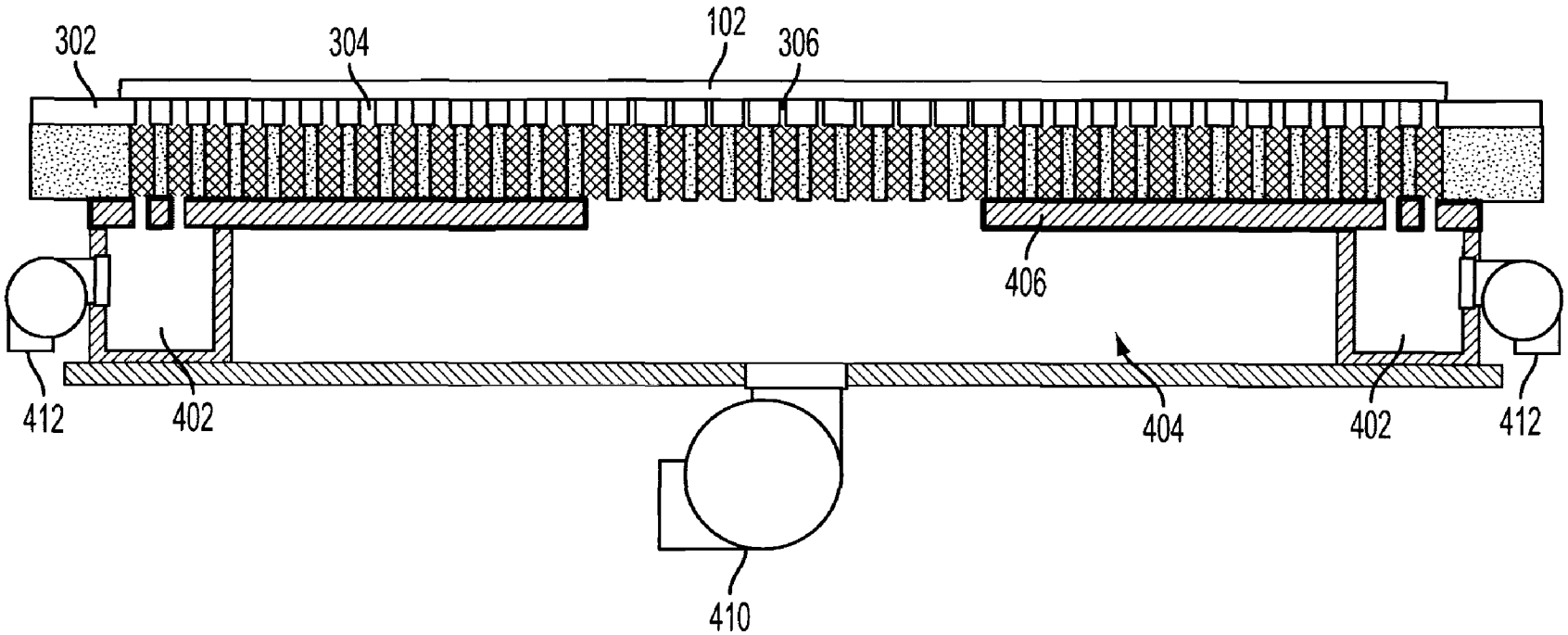
FIG. 5 illustrates an exemplary system view of the printable media transport system shown in FIGS. 4A and 4B according to an embodiment.

FIG. 5 illustrates an exemplary system view of the media hold-down system discussed above in FIGS. 4A and 4B. The system may include two adjustable baffles, like alternative adjustable baffles 134, configured to produce an area of high vacuum pressure 402 positioned to hold down the edge regions of printable medium 102 parallel to the process direction as the printable medium travels along transport surface 302. Between the adjustable baffles, an area of low pressure 404 may be created to hold down the interior region of the printable medium 102. The areas of high pressure 402 may be created by an individual vacuum blower 412. Alternatively, the areas of high pressure 402 may share a single vacuum blower 412, connected by flexible ducting or other similar connections. Likewise, the area of low vacuum pressure 404 may be created by a vacuum blower 410. Depending on the design and application of the media hold-down system, a single blower may be used to create both the areas of high vacuum pressure 402 and the area of low vacuum pressure 404.

As before, one or more tabs 406 may be positioned adjacent to the holes (e.g., holes 304 and 306) of transport surface 302 to reduce the amount of unnecessary or redundant air being pulled through the holes in the area of low vacuum pressure 404. The tabs 406 may be constructed from a material such as plastic, aluminum or steel. The tabs 406, however, may be made from a material that will not deflect as a result of the vacuum pressure created by blower 410.

As illustrated in the discussions of FIGS. 4A, 4B and 5, the media hold-down systems as described above may be used in combination or concert with one another to produce a system having redundant hold down features. It should also be noted that the above disclosed media hold-down systems may be incorporated into numerous printing devices. For example, a high speed print device capable of printing large scale printable media (e.g., 30 inches in width or greater) may utilize the media hold-down systems described herein. Similarly, a smaller scale printer used in an office environment handling mainly standard sized printable media (e.g., 8.5 inches in width) may utilize the media hold-down systems described herein as well. The above disclosed hold-down systems may also be used in printing systems that require a relatively long print zone, such as those that utilize multiple staggered arrays of ink jet print heads.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A printable media hold-down system comprising:

a print head array;

a transport surface positioned adjacent to the print head array which transports a printable medium past the print head array in a location where the print head array may apply ink to the printable medium;

a vacuum system that creates vacuum pressure that holds the printable medium to the transport surface, the vacuum system having at least one adjustable baffle configured to move in a cross process direction and change a dimension of the vacuum system based on a dimension of the printable medium; and a series of tabs configured to block at least a portion of holes in the transport surface adjacent to the interior region.

2. The system of claim 1, further comprising one or more sensors that detect a dimension of the printable medium.

3. The system of claim 1, wherein the at least one adjustable baffle changes a cross process dimension of an area of a transport belt exposed to the vacuum pressure.

4. The system of claim 1, wherein the at least one adjustable baffle defines an area of vacuum pressure in a center portion of the printable media, at least one area of higher vacuum pressure along at least one edge of the printable media, and at least one area of zero vacuum pressure in an area of a transport belt beyond the at least one edge of the printable medium.

5. The system of claim 1, wherein the transport surface has a plurality of holes of various sizes, the holes positioned to create areas of varying vacuum pressure between the transport surface and the printable medium.

6. The system of claim 1, wherein the at least one adjustable baffle is positioned such that the vacuum pressure applied to an edge region of the printable medium parallel to a process direction of the printable medium is higher than the vacuum pressure applied to an interior region of the printable medium.

7. The system of claim 1, wherein the series of tabs are attached to the adjustable baffle.

8. The system of claim 7, wherein the series of tabs move in concert with movement of the adjustable baffle.

9. A printable media hold-down system comprising:

a print head array;

a transport surface positioned adjacent to the print head array which transports a printable medium past the print head array in a location where the print head array may apply ink to the printable medium;

a vacuum system that creates an area of vacuum pressure that holds the printable medium to the transport surface, wherein the vacuum pressure applied to an edge region of the printable medium parallel to a process direction of the printable medium is higher than the vacuum pressure applied to an interior region of the printable medium;

at least one adjustable baffle that changes a cross process dimension of an area of a transport belt exposed to the vacuum pressure; and a series of tabs configured to block at least a portion of holes in the transport surface adjacent to the interior region.

10. The system of claim 9, wherein the at least one adjustable baffle defines an area of vacuum pressure in a center portion of the printable media, at least one area of higher vacuum pressure along at least one edge of the printable media, and at least one area of zero vacuum pressure in an area of the transport belt beyond the at least one edge of the printable medium.

11. The system of claim 9, wherein the at least one adjustable baffle is configured to change a dimension of the area of vacuum pressure based on a dimension of the printable medium.

12. The system of claim 9, further comprising one or more sensors for detecting the dimension of a printable medium.

13. The system of claim 9, wherein the series of tabs are attached to the adjustable baffle.

14. The system of claim 13, wherein the series of tabs move in concert with movement of the adjustable baffle.

15. A printable media hold-down system comprising:

a print head array;

a transport surface positioned adjacent to the print head array which transports a printable medium past the print head array in a location where the print head array may apply ink to the printable medium;

at least one sensor for detecting size and dimension information of the printable medium;

a vacuum system that creates vacuum pressure that holds the printable medium to the transport surface, the vacuum system having at least one adjustable baffle configured to change a dimension of the vacuum system based on a dimension of the printable medium;

wherein the adjustable baffle includes a series of tabs configured to block at least a portion of holes in the transport surface adjacent to the interior region.

16. The system of claim 15, wherein the transport surface has a plurality of holes of various sizes, the holes positioned to create areas of varying vacuum pressure between the transport surface and the printable medium.

17. The system of claim 15, wherein the at least one adjustable baffle is positioned such that the vacuum pressure applied to an edge region of the printable medium parallel to a process direction of the printable medium is higher than the vacuum pressure applied to an interior region of the printable medium.

* * * * *